US005834723A

United States Patent [19]

Wieloch

[11] Patent Number: 5,834,723

[45] Date of Patent: Nov. 10, 1998

[54] APPARATUS FOR RETAINING A MOVABLE CONTACT IN A CIRCUIT INTERRUPTER

[75] Inventor: Christopher J. Wieloch, Brookfield, Wis.

[73] Assignee: Allen Bradley Company, LLC, Milwaukee, Wis.

[21] Appl. No.: 867,365

[22] Filed: Jun. 2, 1997

[51] Int. Cl.[6] ..... H01H 9/44

[52] U.S. Cl. ..... 218/30; 218/31; 218/146; 335/16

[58] Field of Search ..... 218/22–33, 146, 218/155–157; 335/15, 16, 18, 20, 21, 41, 155, 174, 180, 182, 195, 201, 203, 204, 78–86, 124, 128, 131; 361/14, 58, 93, 99, 115

[56] References Cited

U.S. PATENT DOCUMENTS

| | | | |
|---|---|---|---|
| 2,594,396 | 4/1952 | Charbonneau et al. | 200/166 |
| 2,650,328 | 8/1953 | James | 317/37 |
| 2,836,685 | 5/1958 | Pettit | 200/147 |
| 3,064,104 | 11/1962 | Wells et al. | 200/147 |
| 3,806,849 | 4/1974 | Hughes | 335/201 |
| 3,991,391 | 11/1976 | Wafer | 335/16 |
| 4,025,883 | 5/1977 | Slade et al. | 335/16 |
| 5,164,693 | 11/1992 | Yokoyama et al. | 335/14 |
| 5,406,440 | 4/1995 | Wieloch | 361/154 |
| 5,466,903 | 11/1995 | Faber et al. | 200/400 |
| 5,563,756 | 10/1996 | Ignasiak | 361/42 |
| 5,579,198 | 11/1996 | Wieloch et al. | 361/93 |
| 5,587,861 | 12/1996 | Wieloch et al. | 361/14 |

*Primary Examiner*—Michael A. Friedhofer
*Attorney, Agent, or Firm*—Patrick S. Yoder; John M. Miller; John J. Horn

[57] ABSTRACT

An apparatus for retaining a movable contact in a circuit interrupter includes a movable element that is displaced by gas pressure within the interrupter housing resulting from arcs generated during initial displacement of the movable element. The movable element may be a spanner extending between two stationary contacts. The apparatus may be configured as a three phase interrupter in which a single carrier or retainer is common to three power phase sections, and is displaced by interruption of a current carrying path for any one power phase section. The retainer may include a retaining pin which extends through the movable element. The movable element is biased into a conducting position and a head of the retaining pin contacts the movable element to hold it in a non-conducting position following a trip event.

29 Claims, 7 Drawing Sheets

APPARATUS FOR RETAINING A MOVABLE CONTACT IN A CIRCUIT INTERRUPTER

BACKGROUND OF THE INVENTION

The present invention relates generally to the field of electrical circuit interrupter devices, such as circuit breakers, motor protectors and the like. More particularly, the invention relates to an apparatus for retaining a movable contact element in such a device in a non-conducting or circuit interrupted position.

A considerable array of devices are known for interrupting electrical power between conductors. Such devices include circuit breakers of various design and construction, electric motor protectors, and other overcurrent protective devices. In general, such devices provide a path for the flow of electrical power under normal operating conditions, and a mechanism for breaking the current path in the event of an actual or anticipated overcurrent, overtemperature, or other undesirable condition. The current path is typically established by a movable element, such as a pivotable arm carrying a first contact region, and a stationary conductor coupled to a second contact region. The contact regions are brought into contact with one another during normal operation, permitting electrical power to flow through conductors coupled to the first and second contact regions. A sensing device or actuator generally detects fault conditions and triggers movement of the arm to separate the contact regions from one another, thereby interrupting the current path between the conductors. In multiphase devices of this type, a similar arrangement is provided for each phase. Moreover, in the latter case, a trip mechanism typically links the mechanical elements of each phase to ensure that power is interrupted in all phases in the event of a fault in a single phase. A toggle or catch mechanism is generally provided to guard against rebound of the movable arm and recontact of the conductive regions.

Other types of circuit interruption devices include arrangements in which a movable conductive bridge or spanner carrying a pair of contacts extends between two stationary contact regions. When the device is installed in service, source and load conductors are coupled to the stationary contact regions. The bridge serves to complete a current carrying path between the conductors in normal operation. For interruption of current an actuator or interrupt initiation device forces the bridge element away from the stationary contact regions, generating arcs between the separating regions as the bridge element is displaced. A circuit interrupter of this type is described in U.S. Pat. No. 5,579,198, issued on Nov. 26, 1996 to Wieloch et al.

In conventional circuit interrupting devices, such as circuit breakers, a mechanical or electromechanical assembly is associated with the movable contact support to catch or bias the contact support in a non-conducting position following a trip event and to retain the support in the non-conducting position until the device is manually or automatically reset. Common mechanical catch and retaining assemblies included toggle arrangements, snap-action structures and the like, designed to move rapidly to a retaining position following the trip event. An important function of such assemblies is to respond with sufficient rapidity to prevent the movable contact from bouncing or returning to its conductive position, thereby re-establishing the current carrying path.

A goal of most circuit interrupter devices is to interrupt the current carrying path as quickly as possible to limit let-through energy and thereby to ensure the greatest protection for the load coupled to the device. As the response rates of interrupter designs is increased, however, the problem of catching and retaining the movable contact becomes increasingly more difficult. In particular, the retaining device must allow for extremely rapid opening of the electrical circuit, while intervening as quickly thereafter as possible to prevent the movable contact from rebounding. While advances have been made in trip and retaining devices that have enhanced their rapidity, response rates of such devices appear to be limited by their mass and complexity.

There is a need, therefore, for an improved apparatus for interrupting current in electrical circuits that is capable of both opening the circuit extremely rapidly by displacement of a movable contact, and preventing reclosure of the circuit. Moreover, there is a need for a circuit interrupter incorporating a novel technique for preventing rebound of a circuit interrupting element and that alleviates the inconveniences of heretofore known retaining structures, particularly with regard to their complexity, mass and response rate.

SUMMARY OF THE INVENTION

The present invention features an innovative retainer arrangement designed to respond to these needs. The arrangement makes use of gas pressure resulting from arcs generated during displacement of a movable conductive element of a circuit interrupter device to rapidly move a retaining element into a retaining position. The retaining element contacts the movable conductive element to hold it in its interrupted or displaced position, thereby preventing unwanted reclosure of the interrupted circuit. The arrangement may be applied to a wide range of interrupter designs, including designs employing independent spanners as well as those incorporating a rocker-type movable element.

Thus, in accordance with one aspect of the invention, an apparatus is provided for interrupting electrical current between first and second electrical conductors. The apparatus includes first and second conductive elements, biasing means, an interrupt initiation assembly and a retainer. The first conductive element has a first contact region coupled to the first conductor in a current carrying configuration of the apparatus. The second conductive element has a second contact region coupled to the second conductor in the current carrying configuration of the apparatus. The second conductive element is movable between a conducting position wherein the second contact region abuts the first contact region to establish a current carrying path between the first and second conductors, and an interrupted position wherein the second contact region is separated from the first contact region. The biasing means urges the second contact region into the conducting position. The interrupt initiation assembly is coupled to the second conductive element, and urges the second conductive element toward the interrupted position in response to a trip condition. The retainer is displaceable under gas pressure resulting from displacement of the second conductive element from the conducting position. The retainer contacts the second conductive element to retain the second contact region separated from the first contact region.

In accordance with another aspect of the invention, an apparatus for interrupting an electrical current carrying path between two conductors includes an enclosure, first and second stationary contacts, an electrically conductive spanner, biasing means, an interrupt initiation device and a retainer. The stationary contacts are positioned within the enclosure, the first stationary contact being electrically coupled to a first conductor and the second stationary contact being electrically coupled to a second conductor. The spanner is movable between a conductive position wherein the spanner contacts the first and second contacts to establish the current carrying path between the conductors and an interrupted position wherein the spanner is separated from at least one of the first or second stationary contacts to interrupt the current carrying path. The biasing means urges the spanner into the conductive position. The interrupt initiation device is positioned in the enclosure proximate to the spanner, and forces displacement of the spanner from the conductive position to the interrupted position in response to a trip condition. The retainer is movable in the housing between a normal operating position and a retaining position in response to gas pressure resulting from movement of the spanner from the conductive position. The retainer contacts the spanner in the retaining position to retain the spanner in the interrupted position.

In accordance with a further aspect of the invention, an apparatus is provided for interrupting electrical current carrying paths of at least two phases of electrical power. The apparatus includes a plurality of power phase sections and a carrier common to all of the sections. One power phase section is provided for each of the at least two power phases. Each power phase section includes first and second electrical conductors, a first conductive element having a first conductive region coupled to the first conductor, and a second conductive element having a second conductive region coupled to the second conductor when in a conductive position. A current carrying path is thus established for the respective power phase when the second conductive element is in the conductive position. The second conductive element is movable to an interrupted position wherein the second conductive region is separated from the first conductive region to interrupt the current carrying path for the respective power phase. An interrupt initiation device is positioned proximate to the power phase sections and forces displacement of the second conductive element of at least one of the power phase sections from the conductive position to the interrupted position in response to a trip condition. The carrier is movable by gas pressure resulting from displacement of the second conductive element of any of the plurality of power phase sections from its conducting position. The carrier contacts the second conductive elements of the plurality of power phase sections to displace the second conductive elements in their respective interrupted positions.

BRIEF DESCRIPTION OF THE DRAWINGS

The present invention will become more fully understood from the following detailed description, taken in conjunction with the accompanying drawings, wherein like reference numerals refer to like parts, in which.

DESCRIPTION OF THE PRESENTLY PREFERRED EMBODIMENTS

Figure 1:
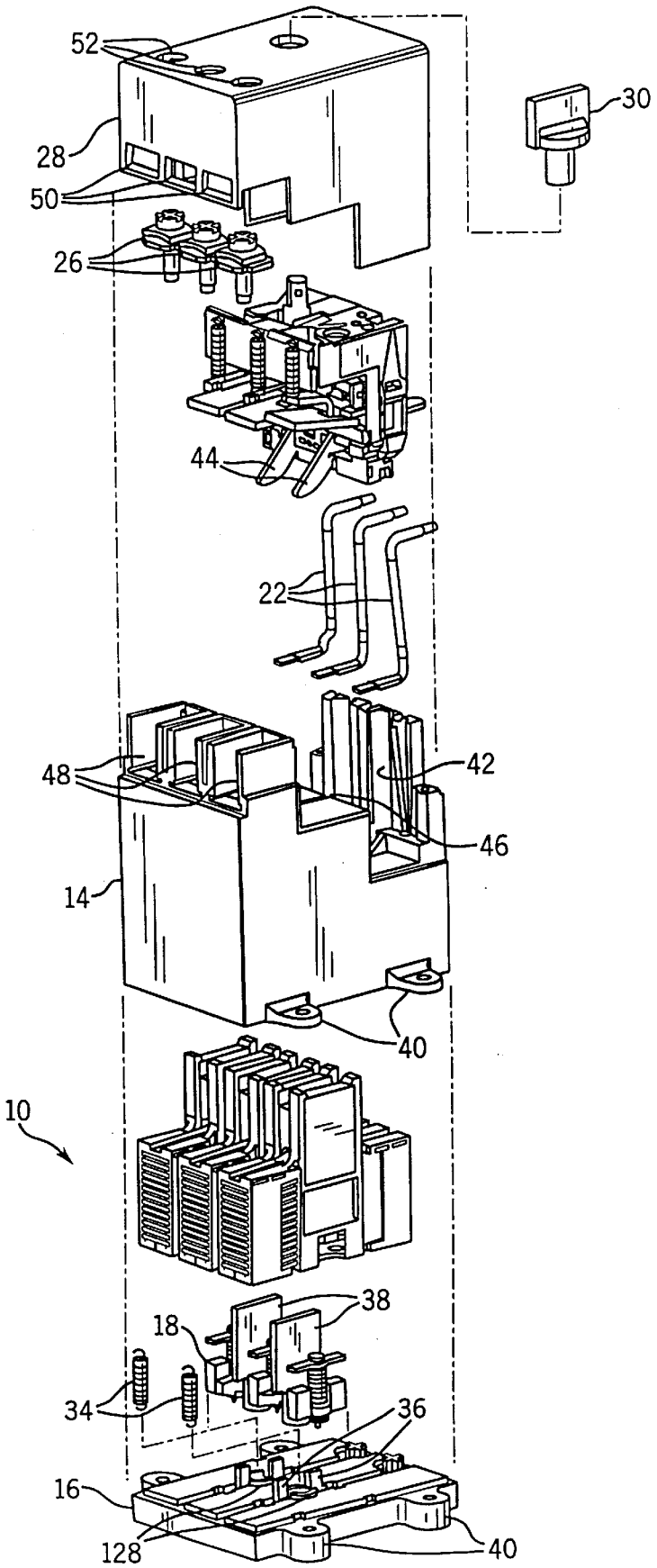
FIG. 1 is an exploded perspective view of the circuit interrupter device for interrupting electrical power in a three phase electrical circuit, illustrating the principle subassemblies of the device.

Turning now to the drawings and referring to FIG. 1, a circuit interrupter, designated generally by the reference numeral 10, is illustrated as including an interrupter module 12, an enclosure or housing 14, a base 16, a spanner/carrier assembly 18 comprising three power phase sections 20, power conductors 22, a mechanical trip/reset assembly 24, terminal assemblies 26 and a cover 28. A manual adjustment knob 30 is also illustrated in FIG. 1 and is designed to operatively fit over an adjustment stem 32 extending from assembly 24 through cover 28 when interrupter 10 is fully assembled. It should be noted that as illustrated in FIG. 1 and as described in the following discussion, interrupter 10 is preferably a three-phase device of the type used to interrupt power to three phases of electrical power. However, to the extent the structure, principles and operation of the device described below are applicable to a single power phase, those skilled in the art will readily appreciate that the device could be adapted to service a single power phase by appropriate modification of the three phase embodiment. It should also be noted that the particular internal construction of mechanical trip/rest assembly 24 does not form part of the present invention and will not be described in detail herein. Such devices are commercially available, such as from Sprecher+Schuh A. G. of Aarau, Switzerland, and generally provide rapid mechanical response to overload and overcurrent conditions and afford a ready means of displacing electrical contact elements until manually or automatically reset.

In the presently preferred embodiment, power phase sections 20 of module 12 are assembled as individual units and are inserted parallel to one another into enclosure 14, as described more fully below. Spanner/carrier assembly 18 is similarly preassembled and is inserted into enclosure 14, supported on base 16 by a pair of biasing springs 34. An array of guide posts 36 extend upwardly from base 16 and aid in locating assembly 18 and in guiding it through its range of movement as described below. Assembly 18 includes a pair of actuator/guide panels 38 extending upwardly into enclosure 14. Panels 38 aid in guiding assembly 18 and contact actuator levers 44 of trip/reset assembly 24 during certain phases of operation of interrupter 10. Following assembly of module 12, assembly 18 and springs 34 in enclosure 14, base 16 is secured to enclosure 14 by screws (not shown) inserted into aligning apertured tabs 40 on enclosure 14 and base 16.

It should be noted that conductors 22 are secured to power phase sections 20 prior to assembly of sections 20 in enclosure 14, and extend upwardly through the enclosure when assembled. A second conductor 58 (see FIGS. 2 and 3) also extends upwardly from each power phase section 20 as described below. Trip/reset assembly 24 is mounted in a bay 42 on enclosure 14, with actuator levers 44 extending through slots 46 provided in an upper wall of enclosure 14. Terminal assemblies 26 are secured to enclosure 14 in appropriate terminal bays 48 and are electrically coupled to second conductors 58 as described below. Cover 28 may then be placed over enclosure 14, terminal assemblies 26 and trip/reset assembly 24. Cover 28 includes conductor apertures 50 and tool apertures 52, permitting conductors (not shown) to be easily connected to terminal assemblies 26 without removal of cover 28.

Figure 2:
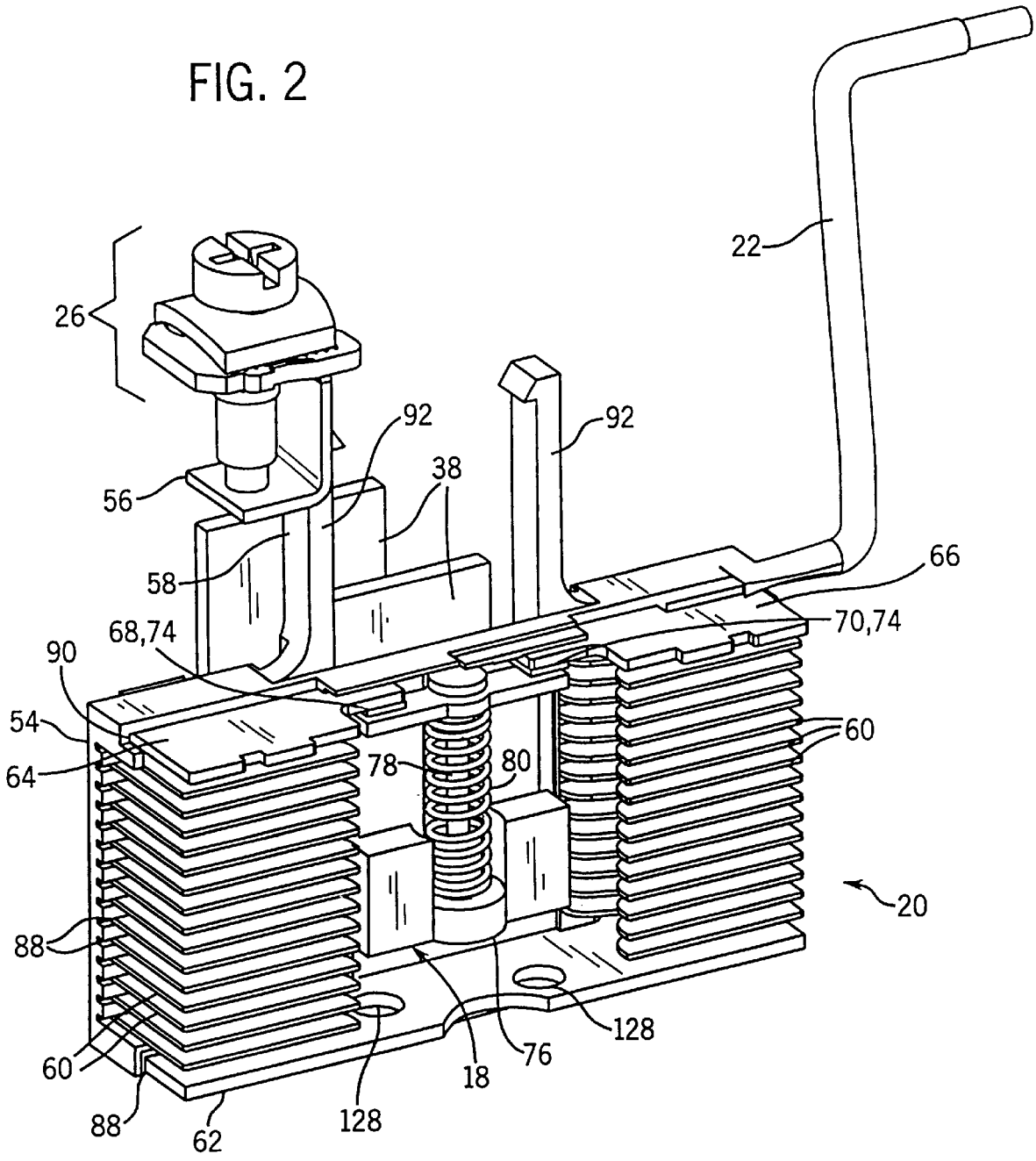
FIG. 2 is a perspective detail view of a power phase section of a circuit interrupter module of the device of FIG. 1, with a side panel of the module removed to illustrate the principle components of the power phase section of the module.
Figure 3:
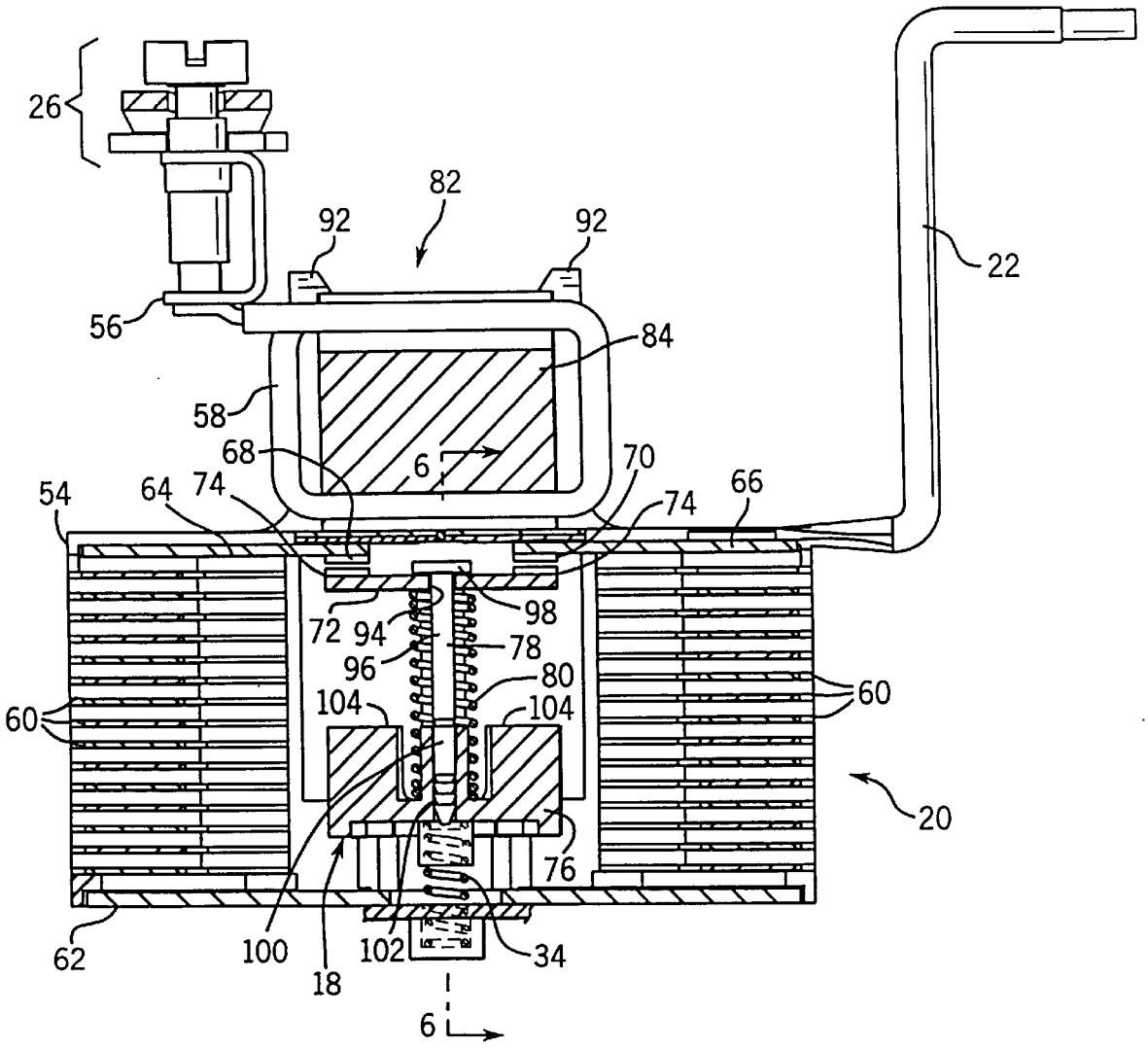
FIG. 3 is a sectional side view of the power phase section shown in FIG. 2 illustrating the electrical connections between the module and conductors for the power phase in which it would be installed.

Referring more particularly now to the preferred construction of interrupter module 12 and spanner/carrier assembly 18, FIGS. 2 and 3 illustrate the components of these assemblies in greater detail. Each power phase section 20 includes a two-piece assembly frame 54 for supporting the various elements of the section. Power is channeled to each section 20 via load side stab conductor 22, and terminal assembly 26 coupled to a connector clip 56 and therethrough to a second, line side conductor 58. Power phase section 20 includes a stack of splitter plates aligned on both line and load sides and a shunt plate 62 bounding a lower region of the section adjacent to the lower-most splitter plate. A first or line side conductive element 64 is provided atop the line side splitter plates; and a second or load side conductive element is provided in facing relation atop the load side splitter plates. Conductive elements 64 and 66 support stationary contacts 68 and 70, respectively, and are electrically coupled, such as by soldering, to line and load side conductors 58 and 22, respectively. Spanner/carrier assembly 18 includes, for each power phase section 20, a movable conductive element 72, preferably in the form of a spanner, carrying a pair of movable contacts 74 (see FIG. 3). Spanner 72 is supported on a carrier 76 via a pin 78, described more fully below, and is biased into a conducting position by a compression spring 80. In the conducting position of spanner 72, movable contacts 74 abut against stationary contacts 68 and 70 to complete a current carrying path through the power phase section between conductors 58 and 22.

Each power phase section 20 also includes an interrupt initiation device 82, preferably including an electromagnetic core 84 for initiating movement of spanner 72 from its conducting position to an interrupted position in response to overload or overcurrent conditions in the current carrying path defined by spanner 72. Core 84 is preferably configured as set forth in U.S. Pat. No. 5,579,198 issued on Nov. 26, 1996 to Wieloch et al., which is hereby incorporated herein by reference. As illustrated in FIG. 3, at least one of conductors 58 and 22 is preferably wound at least one turn around core 84 to aid core 84 in producing an electromotive force for repelling spanner 72 from its conducting position. In the preferred embodiment, line side conductor 58 encircles core 84 approximately one and three-quarters turns between connector clip 56 and its point of attachment to conductive element 64.

As best illustrated in FIG. 2, assembly frame members 54 of each power phase section 20 preferably include molded features designed to support the components described above. For example, frame 54 includes splitter plate support slots 86 arranged along either side of the section, and a shunt plate recess 88 along a bottom edge. Stationary element support slots 90 are provided near an upper end of each frame 54 for receiving and supporting stationary conductive elements 64. Interrupt initiation device support arms 92 extend upwardly from slots 90 to receive and support interrupt initiation device 82. Moreover, internal surfaces of frame members 54 preferably define guides for spanner 72 to prevent rotation of spanner 72 as it is displaced along pin 78 as described below.

A central aperture 94 is formed through spanner 72 for slidingly receiving pin 78. As best illustrated in FIG. 3, pin 78 includes a shank 96 extending through aperture 94, and a head 98 capturing spanner 72 on shank 96. A base 100 of pin 78 is anchored in a pin support recess 102 of carrier 76. Carrier 76 also includes a pair of abutment or support shoulders 104 for contacting spanner 72 in the event of high velocity displacement of spanner 72 as described below. Shoulders 104 define a spring recess 106 of sufficient depth to fully receive spring 80 in a compressed state in the event spanner 72 is driven fully into contact with shoulders 104.

Figure 5:
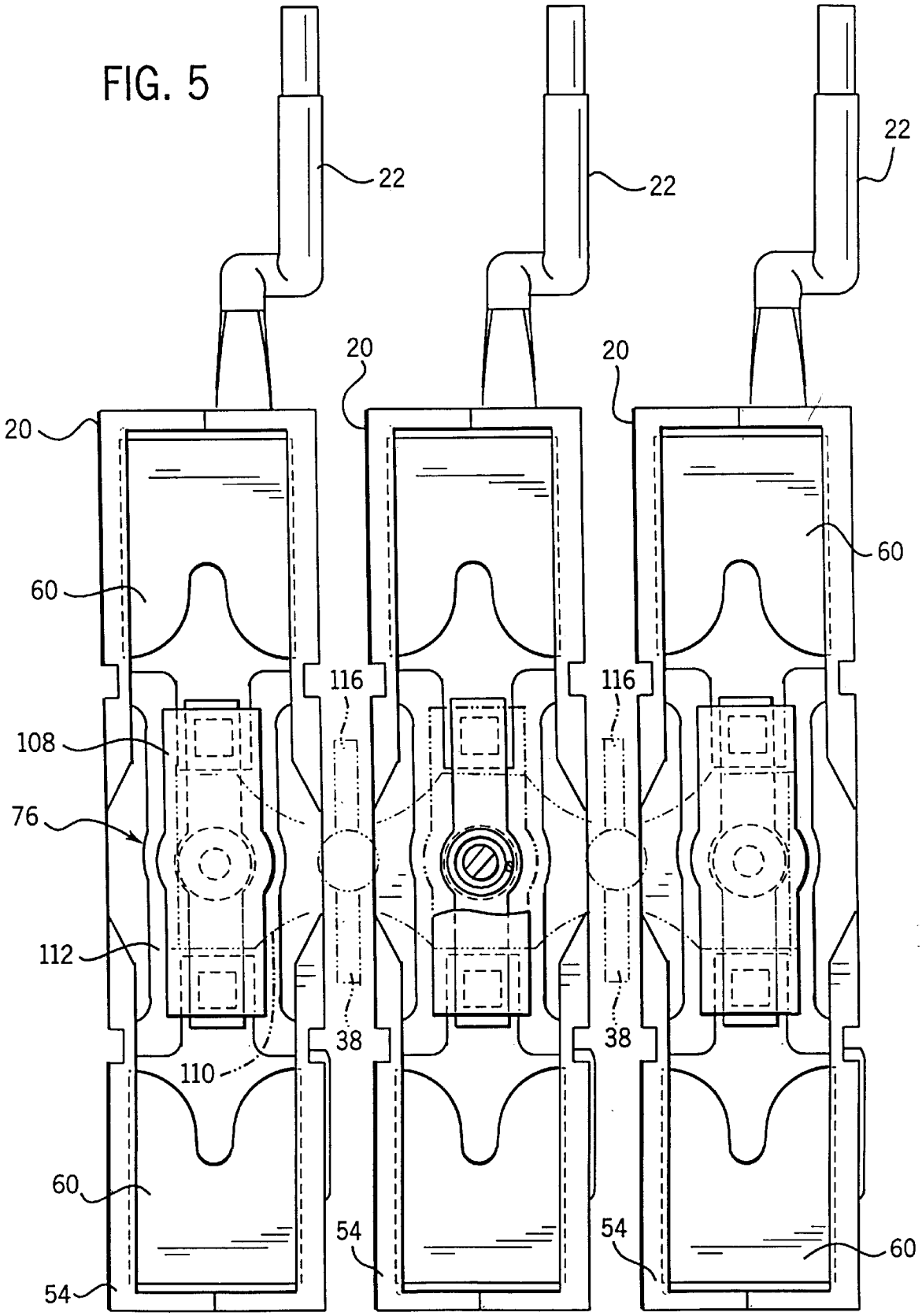
FIG. 5 is an end view of the modules and enclosure of FIG. 4 with the carrier or retainer assembly slidably positioned therein.
Figure 6:
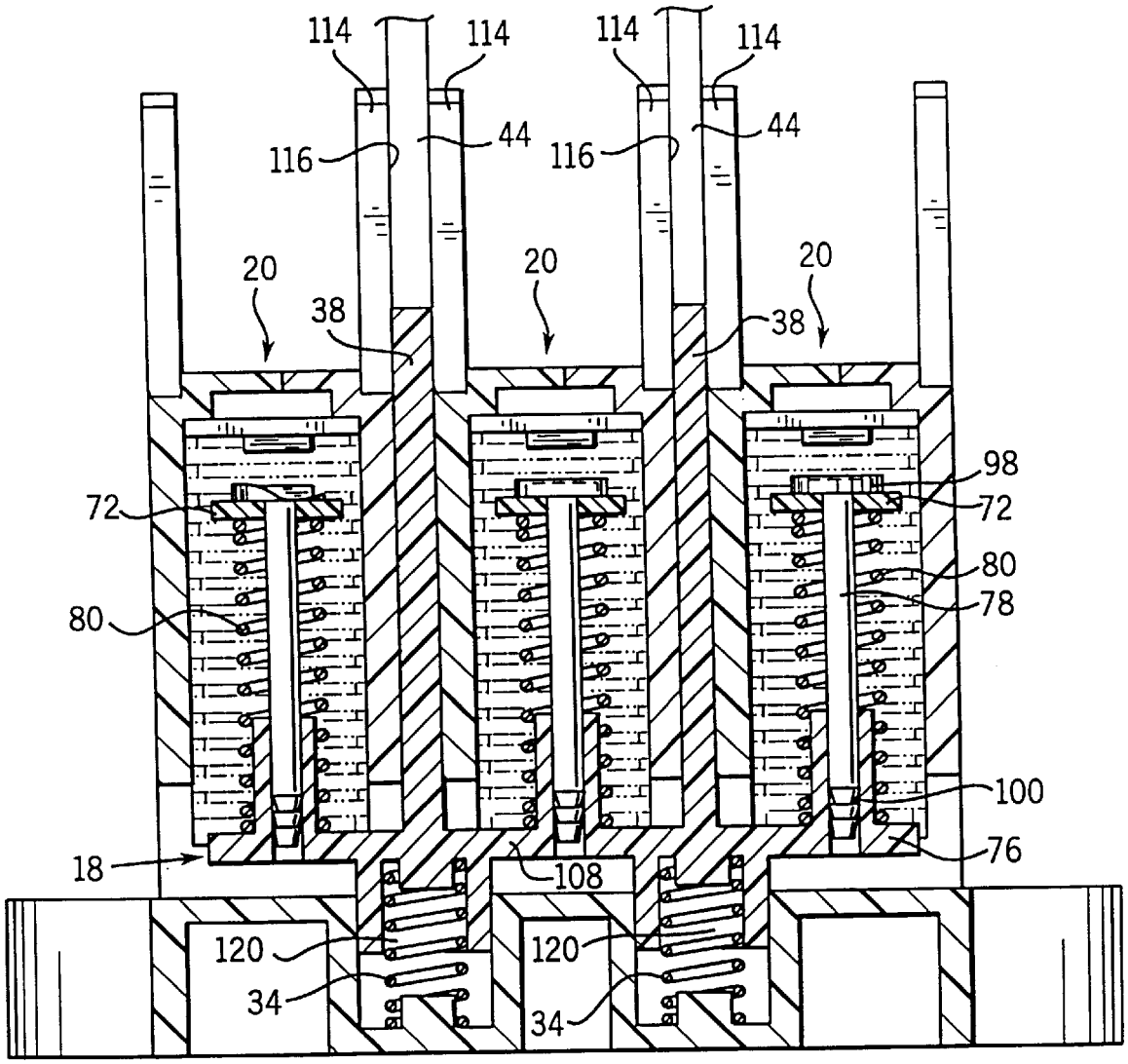
FIG. 6 is a sectional view through the interrupter module and retainer spanner/carrier assembly of FIG. 1 along line 6—6, showing the physical arrangement of the interrupter components.

While the components described above for each power phase section 20 are generally independent for each section, carrier 76 is preferably common to all power phase sections 20. Thus, as shown in FIGS. 5 and 6, carrier 76 includes a base panel 108 extending below the three power phase sections 20. Base panel 108 has an external profile, designated by the reference numeral 10, which conforms to a peripheral shape of an internal cavity 112 of the power phase sections when installed in enclosure 14. A plurality of internal walls or dividers 114 are provided within enclosure 14 for supporting power phase sections 20 and for defining the peripheral shape of internal cavity 112. Moreover, internal walls 114, along with assembly frames 54 define elongated slots 116 for receiving and guiding actuator/guide panels 38 of carrier 76. Cavity 112 is sized so as to be generally closed by carrier 76, but to permit sliding movement of carrier within cavity 112.

Figure 4:
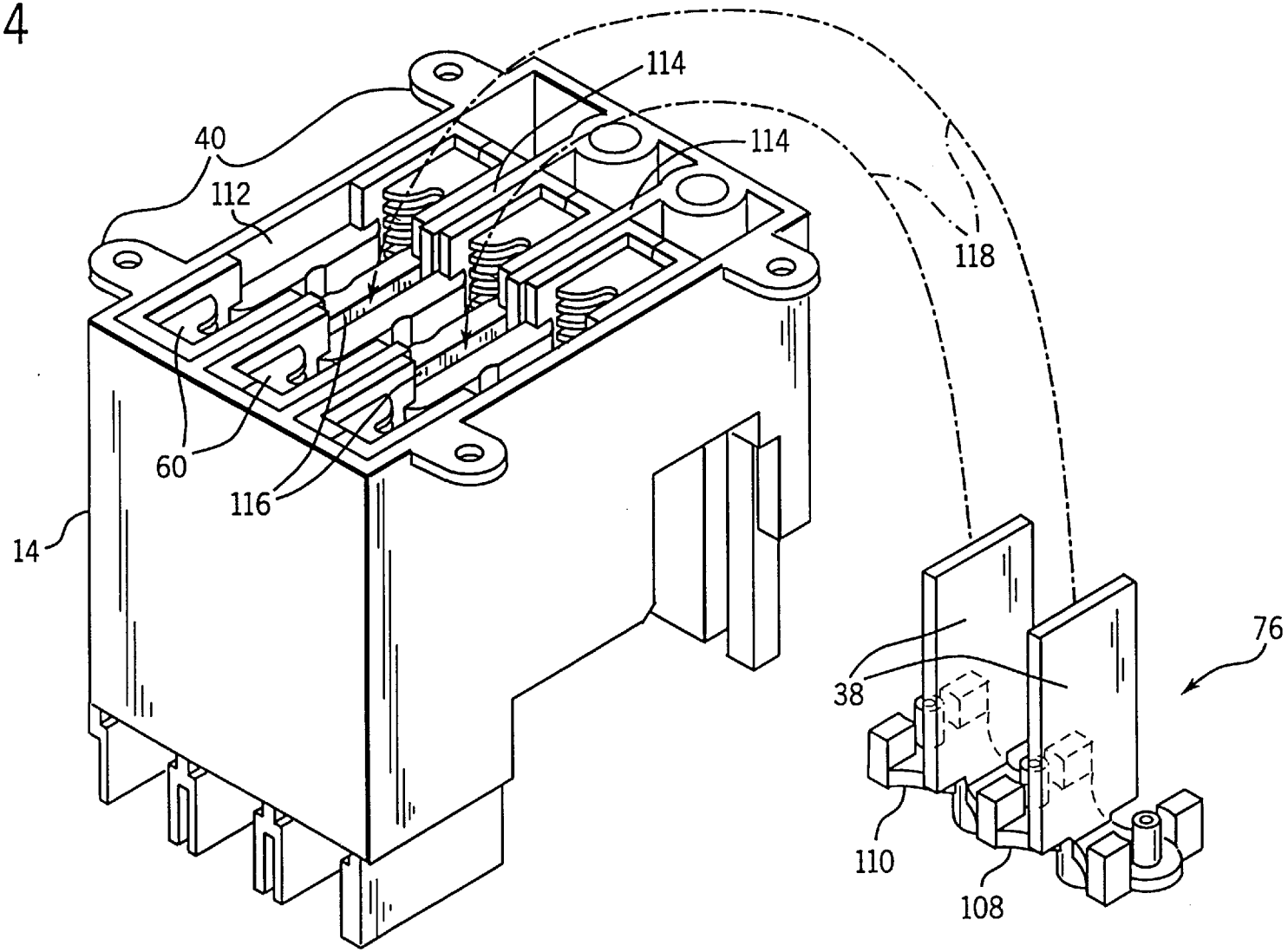
FIG. 4 is a perspective end view of a series of circuit interrupter modules in an enclosure and of a carrier or retainer assembly designed to fit within the enclosure.

For assembly, actuator/guide panels 38 are aligned with slots 116, as indicated by arrow 118 in FIG. 4, and spanner/carrier assembly 18 is slid into place within enclosure 14, placing movable contacts 74 for each power phase section 20 in mutually facing relation with stationary contacts 68, 70 for the respective power phase section (see FIG. 3). As shown in FIG. 5, once placed in enclosure 14, carrier base 108 covers or bounds a lower extremity of cavity 112. To compete assembly, shunt plates 62 are placed over each cavity 1 12, springs 34 are positioned in appropriate locations 120 on a bottom side of carrier base 108 and base 16 is fixed in place to close the enclosure.

FIG. 6 illustrates a side sectional view of the internal components described above following their assembly in interrupter 10. As shown in FIG. 6, once assembled, power phase sections 20 are separated within enclosure 14 by internal walls 114. Spanner/carrier assembly 18 is urged upwardly by springs 34 and, from carrier base 108, the spanner 72 of each power phase section 20 is urged upwardly into its conducting position by springs 80, placing movable contacts 74 in abutting relation with stationary contacts 68 and 70, and completing a current carrying path between conductors 58 and 22 (see FIG. 3). Moreover, within enclosure 14, actuator/guide panels 38 are lodged slidingly within guide slots 116. Adjacent to and above panels 38 in guide slots 116 are actuator levers 44 of trip/reset assembly 24.

In operation, spanner/carrier assembly 18 is urged upwardly into its normal operating position as shown in FIG. 6 by springs 34. Spanners 72 are similarly urged upwardly by springs 80, pressing movable contacts 74 into abutment with stationary contacts 68 and 70 to complete a current carrying path through each power phase section 20. It should be noted that pins 78 are of sufficient length that when carrier 76 is in its raised or biased position shown in FIG. 6, spanners 72 may be brought into contact with stationary contacts 68 and 70 without interference from pin head 98.

When a rapid overcurrent condition occurs in any one of the power phase sections, current through conductor 58 of that section generates an electromagnetic field which is intensified and directed by interrupt initiation device 82. This field acts to repel the spanner for the power phase section in which the overcurrent condition occurred, rapidly moving the spanner from its conducting position against the force of spring 80. In the presently preferred embodiment illustrated, arcs are generated between movable contacts 74 and stationary contacts 68 and 70 during movement of a spanner from its conducting position. Conductive elements 64 and 66 serve as arc runners during this phase of operation, routing expanding arcs toward splitter plates 60 on either side of spanner 72. The slight inertia of spanner 72 allows the spanner to move extremely rapidly from its conducting position, resulting in very rapid expansion of the arcs between the movable and stationary contacts, tending to extinguish the arcs. Each interrupter power phase section 20 preferably operates generally in accordance with the method set forth in U.S. Pat. No. 5,587,861 issued on Dec. 24, 1996 to Wieloch et al., which is hereby incorporated herein by reference.

It should be noted that, although in the preferred embodiment movable conductive element 74 is a spanner which is electrically and physically separated from both stationary contacts in its interrupted position, the retaining technique described herein could also be utilized with structures in which a movable element is separated from a single stationary contact, such as in rocker-type devices. Moreover, those skilled in the art may envision various alternative structures for contacting the movable element with a carrier or retainer in accordance with the principles described below without departing from the spirit and scope of the appended claims.

In addition to aiding in driving spanner 72 from its conducting position and rapidly limiting let-through energy, arcs generated during movement of movable contacts 74 from stationary contacts 68 and 70 heat gases within interrupter 10 and thereby aid in retaining spanners in interrupted positions separated from their stationary contacts. In particular, gases confined within internal cavity 112 are heated by arcs resulting from separation of the spanner of any one of power phase sections 20, creating pressure within enclosure 14. Such expanding gases contact carrier base 108 and rapidly drive carrier 76 downwardly toward base 16, against the force of springs 34. Carrier 76 in turn transports pins 78 of each power phase section downwardly, catching the spanner displaced by the electromotive force of its interrupt initiation device against head 98. In the preferred embodiment illustrated, wherein carrier 76 is common to three power phase sections, carrier pins 78 for power phases not initially interrupted by the overcurrent event also contact their respective spanners during displacement of carrier 76, thereby interrupting power to those power phase sections as well.

Figure 7A:
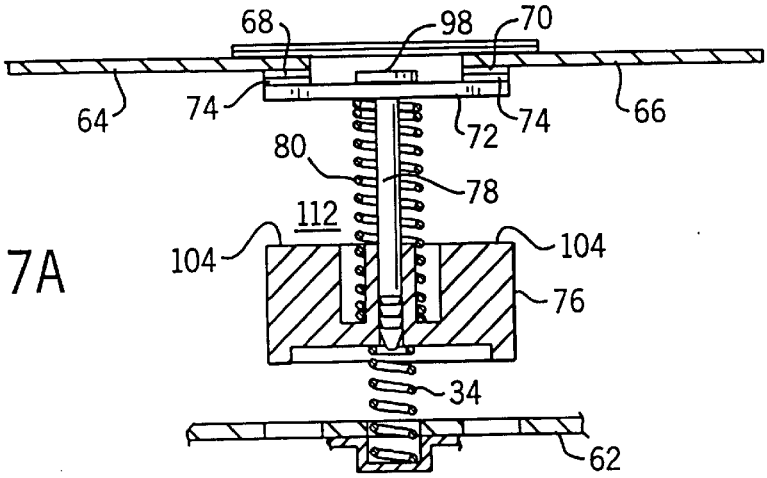
FIGS. 7A–7C are diagrammatical side views of the elements of one power phase section of the module, illustrating, respectively, the movable contact element in its closed or conducting position prior to a trip event, in an intermediate position after initial displacement during a trip event, and in an interrupted position after displacement of the carrier.
Figure 7B:
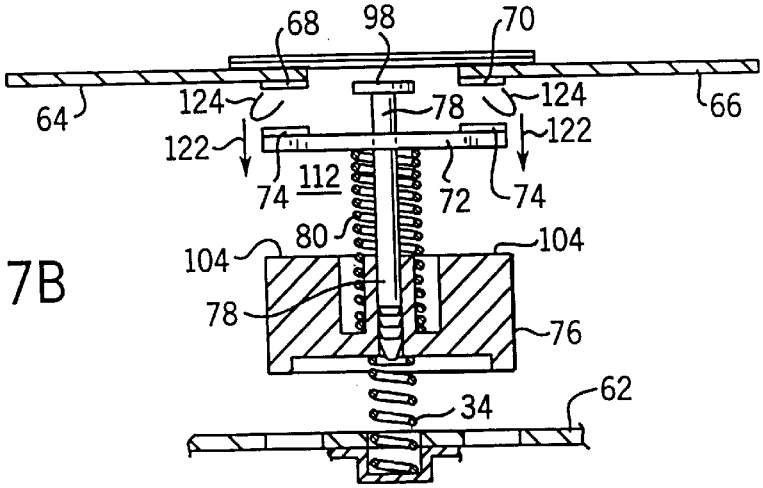
Figure 7C:
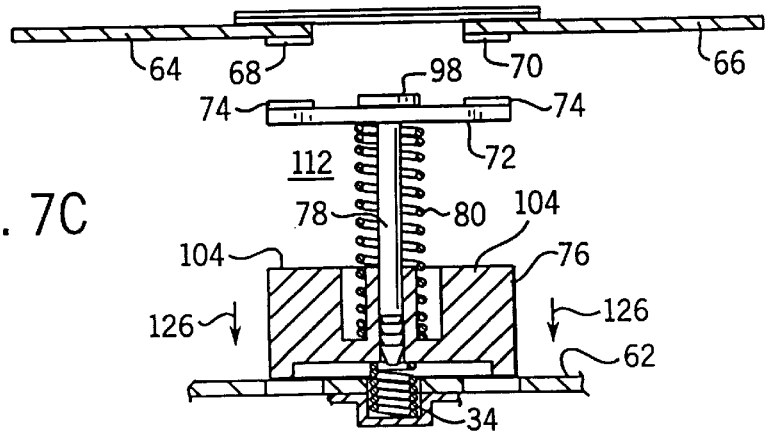

The basic phases of this process are illustrated diagrammatically in FIGS. 7A–7C. FIG. 7A represents carrier 76 in its biased or normal operating position and a spanner 72 in its biased or conductive position prior to a trip event. As shown in FIG. 7B, once the interrupt initiation device initiates separation of spanner 72 from its conductive position as indicated by arrows 122, spanner 72 slides downwardly along pin 78 and arcs 124 are generated between movable contacts 74 and stationary contacts 68 and 70. These arcs expand rapidly due to the high velocity of spanner 72 and heat gases within cavity 112. As shown in FIG. 7C, pressure resulting from these gases drives carrier 76 downwardly, as indicated by arrows 126, against the force of springs 34 until carrier base 108 contacts shunt plates 62 (or base 16). In this lowered or retaining position of carrier 76, head 98 of pin 78 contacts an upper side of spanner 72, restraining spanner 72 from rebounding and recontacting stationary contacts 68 and 70. If spanner 72 is displaced with sufficient force, spanner 72 may contact shoulders 104 of carrier 76, protecting spring 80 from being crushed or damaged.

It should be noted that, while sufficient clearance is provided within cavity 112 for relatively free sliding movement of carrier 76, carrier base 108 fits sufficiently tightly within cavity 112 to displace carrier 76 before gas pressure can dissipate following generation of arcs from displacement of a spanner. Moreover, vents 128 are preferably provided in base 16, behind carrier base 108, through which gases eventually dissipate following displacement of carrier 76. Thus, carrier 76 is driven into its retaining position by expanding gases within enclosure 14 and is held in the retaining position for the period of time necessary for gas pressure to dissipate by leakage around carrier base 108 and through vents 128 (see FIGS. 1 and 2), and any other openings in enclosure 14. Eventually, as gas pressure dissipates within enclosure 14, springs 34 will overcome forces against carrier 76 resulting from the gas pressure, and carrier 76 will again return to its biased position, thereby resetting interrupter 10.

While the dissipation of gas pressure within enclosure 14 may be used to reset interrupter 10, in the preferred embodiment illustrated, mechanical trip/reset assembly 24 is preferably also tripped following an overcurrent condition. Tripping of assembly 24 results in movement of actuator levers 44 downwardly within guide slots 116 (see FIG. 6), to a point where actuator levers 44 contact actuator/guide panels 38 of carrier 76 to hold carrier 76 in its interrupted or retaining position. Response of assembly 24 preferably occurs prior to dissipation of gas pressure within enclosure 14 sufficient to permit return of carrier 76 to its normal or biased position. Once tripped, assembly 24 will hold carrier 76 in the retaining position until reset in a conventional manner via knob 30. It should also be noted that, while spanner 72 and carrier 76 are designed to respond extremely quickly to overcurrent conditions, mechanical trip/reset assembly 24 is adapted to respond to more slowly occurring conditions, such as thermal overloads.

While the embodiments illustrated in the Figures and described above are presently preferred, it should be understood that these embodiments are offered by way of example only and may be adapted to various other structures.

What is claimed is:

1. An apparatus for interrupting electrical current between first and second electrical conductors comprising:

a first conductive element having a first contact region coupled to the first conductor in a current carrying configuration of the apparatus;

a second conductive element having a second contact region coupled to the second conductor in the current carrying configuration of the apparatus, the second conductive element being movable between a conducting position wherein the second contact region abuts the first contact region to establish a current carrying path between the first and second conductors, and an interrupted position wherein the second contact region is separated from the first contact region;

biasing means urging the second contact region into the conducting position;

an interrupt initiation assembly coupled to the second conductive element, the interrupt initiation assembly urging the second conductive element toward the interrupted position in response to a trip condition; and a retainer, the retainer being displaceable under gas pressure resulting from displacement of the second conductive element from the conducting position, the retainer contacting the second conductive element to retain the second contact region separated from the first contact region.

2. The apparatus of claim 1, wherein the second conductive element is a movable spanner.

3. The apparatus of claim 2, wherein the retainer includes a retaining pin having an abutment end, the spanner being slidable along the retaining pin, and wherein the biasing means includes a spring surrounding a portion of the retaining pin, the spanner being retained in the interrupted position by the abutment end of the retaining pin.

4. The apparatus of claim 1, wherein the first conductive element is stationary.

5. The retainer of claim 4, wherein the vent is provided in a portion of the housing adjacent to the carrier and wherein the carrier at least partially covers the vent when in the retaining position to limit flow of gases from the housing through the vent.

6. The apparatus of claim 1, wherein the second conductive element is electrically separated from the second conductor in the interrupted position.

7. The apparatus of claim 1, wherein the second conductive element includes a third conductive region, and wherein the apparatus further includes a third conductive element having a fourth conductive region, the first and second conductive regions abutting one another and the third and fourth conductive regions abutting one another in the conducting position.

8. The retainer of claim 7, wherein the retainer includes a common carrier extending between the adjacent bays, the common carrier being movable to the retaining position under the influence of expanding gases resulting from a trip condition in any one of the three phases.

9. The apparatus of claim 1, further including a housing surrounding at least the first and second conductive elements and the retainer, the gas pressure resulting from displacement of the second conductive element being contained by the housing.

10. The apparatus of claim 9, wherein the housing comprises a guide for directing movement of the second conductive element.

11. The apparatus of claim 9, wherein the housing comprises a guide for directing movement of the retainer.

12. The apparatus of claim 1, wherein the interrupt initiation assembly includes an electromagnetic core disposed proximate to the second conductive element, the electromagnetic core forcing movement of the second conductive element by an electromotive force resulting from the trip condition.

13. The retainer of claim 1, wherein the carrier is slidable within the housing and the biasing device includes a spring extending between the housing and the carrier.

14. The retainer of claim 1, wherein the retainer further comprises a biasing spring extending between the carrier and the movable element.

15. The retainer of claim 1, wherein the circuit interrupter device includes first and second stationary contacts, the first stationary contact being electrically coupled to a source-side conductor and the second stationary contact being coupled to a load-side conductor, and wherein the movable element includes first and second movable contacts, the first movable contact being electrically coupled to the first stationary contact and the second movable contact being electrically coupled to the second stationary contact when the movable element is in the closed position.

16. The retainer of claim 1, wherein the movable element includes an aperture and the retaining element includes a pin extending through the aperture, the pin having an abutting surface at one end thereof for contacting the movable element.

17. The retainer of claim 1, wherein the housing includes a vent permitting gases within the housing to escape following separation of the movable and stationary contacts.

18. The retainer of claim 1, wherein the circuit interrupter device is a three phase interrupter including stationary and movable contacts for each of three phases of electrical power, and wherein the housing includes adjacent bays for the movable and stationary contacts for each phase.

19. An apparatus for interrupting an electrical current carrying path between two conductors comprising:

an enclosure;

first and second stationary contacts positioned within the enclosure, the first stationary contact being electrically coupled to a first conductor of the two conductors and the second stationary contact being electrically coupled to a second conductor of the two conductors;

an electrically conductive spanner movable between a conductive position wherein the spanner contacts the first and second contacts to establish the current carrying path, and an interrupted position wherein the spanner is separated from at least one of the first or second stationary contacts to interrupt the current carrying path;

biasing means urging the spanner into the conductive position;

an interrupt initiation device positioned in the enclosure proximate to the spanner, the interrupt initiation device forcing displacement of the spanner from the conductive position to the interrupted position in response to a trip condition; and a retainer movable in the housing between a normal operating position and a retaining position in response to gas pressure resulting from movement of the spanner from the conductive position, the retainer contacting the spanner in the retaining position to retain the spanner in the interrupted position.

20. The apparatus of claim 19, further including means for biasing the retainer into the normal operating position.

21. The apparatus of claim 19, wherein the housing includes interior surfaces defining a gas expansion chamber, and wherein the retainer includes an impingement portion at least partially covering an end of the expansion chamber, whereby gases heated by displacement of the spanner cause displacement of the retainer in the gas expansion chamber.

22. The apparatus of claim 19, wherein the interrupt initiation assembly includes an electromagnetic core disposed proximate to the second conductive element, the electromagnetic core forcing movement of the second conductive element by an electromotive force resulting from the trip condition.

23. The apparatus of claim 22, wherein at least one of the conductors wraps at least one turn around the electromagnetic core.

24. The apparatus of claim 19, wherein the retainer includes a retaining pin having an abutment end, the spanner being slidable along the retaining pin, and wherein the biasing means includes a spring surrounding a portion of the retaining pin, the spanner being retained in the interrupted position by the abutment end of the retaining pin.

25. An apparatus for interrupting electrical current carrying paths of at least two phases of electrical power comprising:

a plurality of power phase sections, one power phase section for each of the at least two power phases, each of the power phase sections power phase section including first and second electrical conductors, a first conductive element having a first conductive region coupled to the first conductor, and a second conductive element having a second conductive region coupled to the second conductor in a conductive position whereby a current carrying path is established for the respective power phase, the second conductive element being movable to an interrupted position wherein the second conductive region is separated from the first conductive region to interrupt the current carrying path for the respective power phase;

an interrupt initiation device positioned proximate to the power phase sections, the interrupt initiation device forcing displacement of the second conductive element of at least one of the power phase sections from the conductive position to the interrupted position in response to a trip condition; and a carrier common to the plurality of power phase sections, the carrier movable by gas pressure resulting from displacement of the second conductive element of any of the plurality of power phase sections from the conductive position, the carrier contacting the second conductive elements of the plurality of power phase sections to displace the second conductive elements in their respective interrupted positions.

26. The apparatus of claim 25, wherein for each of the power phase sections the second conductive element includes a third conductive region, and wherein each of the power phase sections further includes a third conductive element having a fourth conductive region, the first and second conductive regions abutting one another and the third and fourth conductive regions abutting one another in the conducting position.

27. The apparatus of claim 25, further comprising an enclosure, the enclosure including interior surfaces defining a gas expansion chamber, and wherein the carrier includes an impingement portion at least partially covering an end of the expansion chamber, whereby gases heated by displacement of the second conductive element for any of the plurality of power phase sections cause displacement of the carrier in the gas expansion chamber.

28. The apparatus of claim 25, wherein the second conductive elements for the plurality of power phase sections are supported on the carrier.

29. A retainer for maintaining a movable element in a circuit interrupter device, the device including a movable contact and a stationary contact, the movable contact being supported by the movable element, the movable element being displaceable between an open position wherein the movable contact is separated from the stationary contact and a closed position wherein the movable contact is electrically coupled to the stationary contact to complete an electrical current carrying path through the device, an enclosure at least partially surrounding the stationary contact to contain volumetric expansion of gases heated by separation of the movable and stationary contacts, the retainer comprising:

a carrier movable with respect to the housing between an operating position and a retaining position under the influence of the gases;

a biasing device cooperating with the carrier for urging the carrier into the operating position; and a retaining element movable with the carrier, the retaining element contacting the movable element in the retaining position of the carrier to maintain the movable element in the open position.

* * * * *